US009248349B2

(12) United States Patent
Boyan

(10) Patent No.: US 9,248,349 B2
(45) Date of Patent: Feb. 2, 2016

(54) EYES ON THE BALL

(75) Inventor: Joseph M Boyan, Bay Head, NJ (US)

(73) Assignee: Joseph M Boyan, Florham Park, NJ (US)

( * ) Notice: Subject to any disclaimer, the term of this patent is extended or adjusted under 35 U.S.C. 154(b) by 1422 days.

(21) Appl. No.: 12/696,210

(22) Filed: Jan. 29, 2010

(65) Prior Publication Data

US 2011/0190081 A1 Aug. 4, 2011
US 2013/0102422 A9 Apr. 25, 2013

Related U.S. Application Data

(60) Provisional application No. 61/148,344, filed on Jan. 29, 2009.

(51) Int. Cl.
*A63B 37/00* (2006.01)
*A63B 43/04* (2006.01)
*A63B 69/00* (2006.01)

(52) U.S. Cl.
CPC ..... *A63B 43/04* (2013.01); *A63B 69/00* (2013.01)

(58) Field of Classification Search
CPC ..... A63B 43/04; A63B 69/00
USPC ..... 473/451, 600, 602; D21/707, 713, 7
See application file for complete search history.

(56) References Cited

U.S. PATENT DOCUMENTS

| | | | | | |
|---|---|---|---|---|---|
| 2,278,649 | A * | 4/1942 | Dickson et al. | 473/602 | |
| 2,504,650 | A * | 4/1950 | Chessrown | A63B 43/00 273/155 | |
| 3,655,197 | A * | 4/1972 | Milbaum | 273/146 | |
| 3,679,212 | A * | 7/1972 | Smith | 273/144 B | |
| 4,194,737 | A * | 3/1980 | Farmer | 473/570 | |
| 4,257,598 | A * | 3/1981 | Massino | 473/598 | |
| 4,572,507 | A * | 2/1986 | Hubbert et al. | 473/601 | |
| 4,815,737 | A * | 3/1989 | Su et al. | 473/598 | |
| 5,407,193 | A * | 4/1995 | McGinley | 473/451 | |
| 5,609,953 | A * | 3/1997 | Tamura | 428/316.6 | |
| 5,810,602 | A * | 9/1998 | Menelly | 434/302 | |
| 5,885,177 | A * | 3/1999 | Teifert et al. | 473/598 | |
| 6,056,622 | A * | 5/2000 | Chung | 446/435 | |
| 6,287,226 | B1 * | 9/2001 | Dilling | 473/594 | |
| 6,659,866 | B2 * | 12/2003 | Frost et al. | 463/17 | |
| 6,755,753 | B2 * | 6/2004 | Nesbitt et al. | 473/355 | |
| 6,991,561 | B2 * | 1/2006 | Nesbitt et al. | 473/355 | |
| 7,048,656 | B2 * | 5/2006 | Litchfield | 473/598 | |
| 7,520,830 | B2 * | 4/2009 | Wong | 473/594 | |

* cited by examiner

*Primary Examiner* — Vishu Mendiratta
(74) *Attorney, Agent, or Firm* — Rankin, Hill & Clark LLP

(57) ABSTRACT

An embodiment herein includes a baseball having a cover and a core. The cover encapsulates the core and there at least four images on an exterior surface of the cover. At least four of the images do not substantially extend from one of the panels to another one of the panels. The ball may have a profile substantially similar to a conventional ball. A second embodiment of the ball is where the core is weighted in an asymmetric manner. A method of using an embodiment of the ball includes a player calling out a description of the image as the player fields the ball.

16 Claims, 2 Drawing Sheets

EYES ON THE BALL

RELATED APPLICATION

Under 35 U.S.C. §119 or 35 U.S.C. §120, 121 or 365(c) Applicant hereby claims the benefit of priority to earlier filed patent application having the Ser. No. 61/148,344, filed Jan. 29, 2009, having the same inventor Mr. Joseph M. Boyan.

BACKGROUND

1. Field of the Disclosure

The claims of the application in general relate to the game of baseball, and in particular to a baseball which can be used to practice the game of baseball. Additionally, the disclosed baseball can be used as a training aid to improve a baseball player's ability to field the baseball.

2. Background Art

Typically new, usually young, baseball players practice fielding ground balls with the same baseball used in the game. Frequently their task is to catch a ground ball in their glove and then throw the ball to the appropriate base before a runner reaches that base. A mistake commonly made is to look to the target base before the ball is secured in the fielder's glove, resulting in a failure to catch the ball. This can happen for numerous reasons; such as if the ball bounces other than anticipated by the fielder, the fielder does not have his or her glove on the ground in the open position ready to receive the ball, etc. The afore are just two examples of common reasons why a fielder may not properly field the baseball. Others do exist.

BRIEF DESCRIPTION

In one embodiment of a baseball disclosed herein, the baseball includes a core and a cover. The cover includes at least two panels adjacent one another, which completely encapsulate the core. An exterior surface of the cover includes four or more images. At least four of the images do not substantially extend from one of the panels to another one of the panels. A second embodiment of the baseball disclosed herein is a baseball having a core and a cover. The cover completely encapsulates the core. The baseball is weighted in an asymmetrical manner.

Also disclosed herein is a method of teaching fielding a baseball. The method includes directing a baseball having a core and a cover. The cover includes at least two panels adjacent one another and the cover completely encapsulate the core. An exterior surface of the cover includes four or more images, wherein at least each one of the four images does not extend from a first panel to a second panel. The method further includes instructing a fielder to announce the image visible to the fielder as the fielder fields the baseball.

Further disclosed herein is a method of selling a baseball. The method includes selling a baseball having a core and a cover. The cover includes at least two panels adjacent one another and the cover completely encapsulates the core. An exterior surface of the cover includes four or more images. The method further includes instructing the user to have a fielder announce the image visible to the fielder as the fielder fields the baseball.

It is to be understood that both the foregoing brief description and the following detailed description provide embodiments which are intended to provide an overview or framework of understanding, the nature and character of the invention as it is claimed. The accompanying drawings are included to provide a further understanding of the invention and are incorporated in and constitute a part of the specification. The drawings illustrate various embodiments of the invention and together with the description serve to describe the principles and operations of the invention.

DETAILED DESCRIPTION

Figure 1:
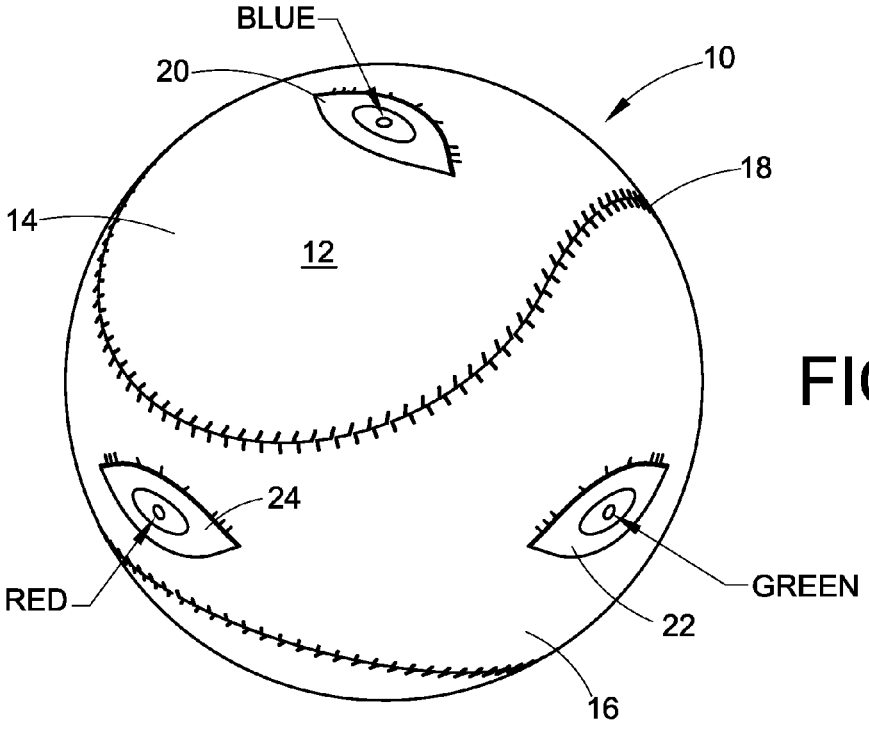
FIG. 1 is a perspective view of an embodiment of a practice baseball.

As depicted in FIG. 1, a practice baseball 10 is disclosed herein. Baseball as used herein is used in the general sense in that ball 10 may be what is commonly referred to as a hard ball, a softball, a tee ball, or any other derivation of a ball which may be used to play the game of baseball, softball (fast or slow pitch), or tee-ball. Thus the following disclosure is also applicable to the aforementioned types of balls. The baseball includes a core not shown and a cover 12. Cover 12 as shown includes two (2) panels 14 and 16; preferably cover 12 encapsulates the core. Ball 10 is not limited by the number of panels used to encapsulate the core, cover 12 may include any number of panels. As shown panels 14 and 16 are stitched together by stitches 18. Ball 10 is not limited to the use of stitches, any technique may be used to apply the panels around the core, such as but not limited to gluing the panels in desired locations on an outer surface of the core. Panels 14 and 16 are adjacent one another. Ball 10 has substantially the same profile as a conventional baseball. Alternative ball 10 has a profile that it may be used to practice the game of baseball and/or play the game.

Figure 2:
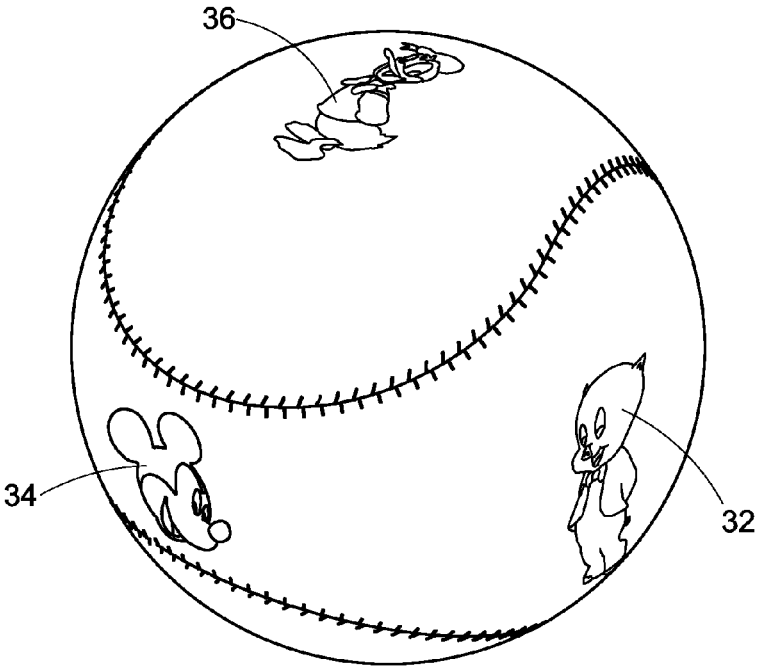
FIG. 2 is a perspective view of a further embodiment of a practice baseball.

Three or more images 20, 22, and 24 are located on an exterior surface of cover 12. In one embodiment, ball 10 includes four or more images, preferably up to about six images. The images may be the same or different or any combination thereof. In one particular embodiment, the images are the same shape. In another particular embodiment, the images are different shapes. In a further particular embodiment, the images are the same except they differ in color. In a certain embodiment, each image is of an eye as shown in FIG. 1. As shown in FIG. 2, each image may be a different character, 32, 34, and 36. Some examples of characters include cartoon characters, super heroes, national flags, other icons of choice and any combination thereof. The images do not substantially extend from cover 12 to the extent to no more than normally effect how ball 10 rolls, preferably the images do not interfere with how ball 10 rolls.

In one embodiment each image includes at least about 2 colors, preferably at least about 3 colors. In another embodiment at least 3, preferably at least about 4, more preferably at least about 5, of the images are more than a monochromatic section of one of the panels. In a further embodiment at least 3, preferably at least about 4, more preferably at least about 5, of the images comprise other than a monochromatic section of one of the panels.

In a particular embodiment of ball 10, identical images may be located on diametrically opposite surfaces of ball 10. Further, non-opposing images may differ in easily recognizable characteristics. In an alternative embodiment, all of the images are distinctive from one another. In one certain embodiment, the images are all in pairs and each of the pairs are substantially the same. Furthermore, each first member of each pair may be located opposed from the second member of the pair. Each of a pair of images has the same color, which is different from each other pair of images. In a further alternate embodiment, all images are the same except for the color.

In an embodiment of ball 10, which includes two panels 14 and 16, ball 10 includes four major sections two of which are shown as 42 and 44 and two minor sections, one of which is indicated as 52. In this embodiment, preferably each major section includes an image. In a further embodiment each major section includes an image and at least one of the minor sections. Preferably in the afore embodiments, any particular image would no more than nominally extend across seam 18. In a further embodiment, at least half of the images do not extend across seam 18, more preferably none of the images extend across seam 18.

The images are not limited to being located on any particular panel. All of the images may be located on one panel, the images may be uniformly dispersed between or among the panels, the images may be randomly dispersed on the panels, or any combination thereof. In one example of two panel ball 10, no more than two images are located on any one of the panels.

With respect to the core, the core may be weighted substantially symmetrically or substantially asymmetrically. In one embodiment, if the core is weighted symmetrically, preferably ball 10 rolls in a non-lopsided manner. In another embodiment, if the core is weighted asymmetrically, the ball may roll in a lopsided manner. In a further embodiment, if ball 10 is weighted symmetrically, ball 10 may roll in a true fashion and conversely if ball 10 is weighted in an asymmetric manner, ball 10 may roll in an untrue fashion. A definition that may be used for true is movement in an unswerving fashion.

In a further embodiment a wrap may be added to ball 10 having a symmetrically weighted core such that the assembly of ball 10 and the wrap would be asymmetrically weighted. In one embodiment, wrap 10 may comprise a conformable material, which is unevenly wrapped around ball 10. In a second embodiment, the wrap may comprise a pliable material. In a third embodiment, wrap 10 may comprises a material that does not have a substantially uniform thickness, such that when the wrap is applied to ball 10 the assembly of the wrap and ball 10 rolls in an untrue fashion.

Figure 3:
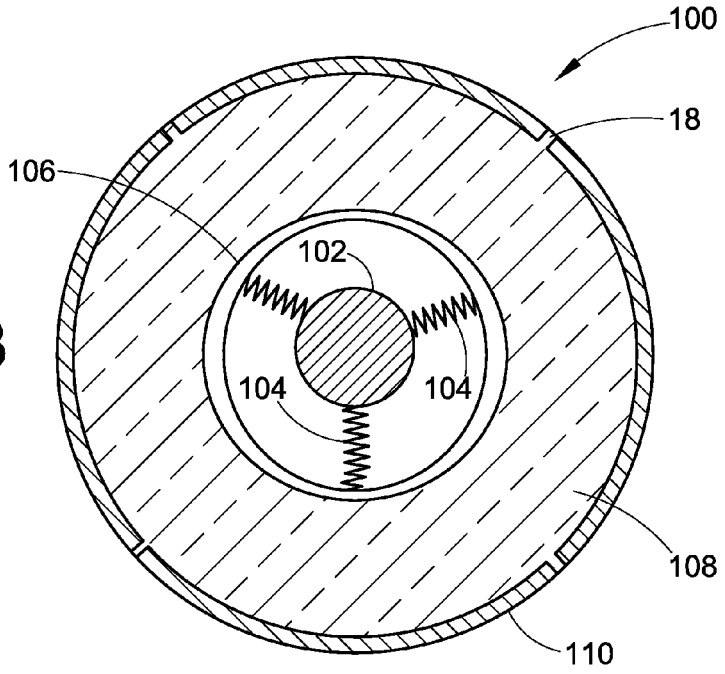
FIG. 3 is a cross sectional view of another embodiment of a practice baseball.
Figure 4:
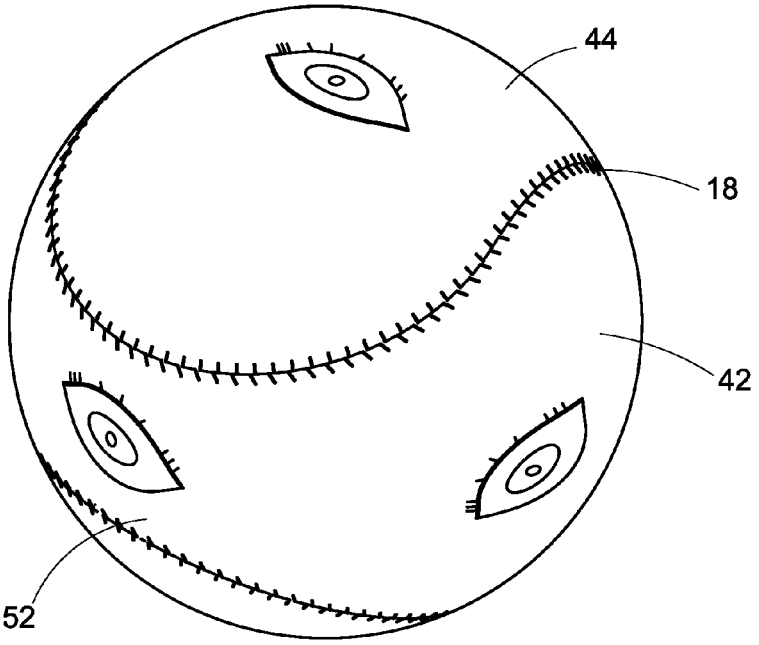
FIG. 4 is a perspective view of another embodiment of a practice baseball.

A further embodiment is depicted in FIG. 3. In FIG. 3, ball 100 is shown in cross section. Ball 100 includes a central mass 102 and a plurality of springs 104 extending from mass 102, optionally springs 104 may be attached to mass 102. Mass 102 may be constructed from various materials such as rubber, plastic, metal, or any combination thereof. As for springs 104, it is preferred that the number of springs is sufficient to introduce variability into the rolling path of ball 100 after ball 100 strikes the ground after ball 100 is hit, thrown, kicked, or by other means directed toward a fielder. In one embodiment, when mass 102 is attached to springs 104 the direction of each bounce of ball 10 will vary in an unpredictable manner.

Springs 104 extend to an intermediate layer 106. Intermediate layer 106 has sufficient rigidity to maintain tension on springs 104 and sufficient pliability to transfer force applied to the outer surface of layer 106 to the spring or springs 104 that are in communication with the portion of layer 106 that receives the force. Layer 106 does not need to transfer all of the force to spring(s) 104, just at least a sufficient amount of the force to compress spring(s) 104. In one embodiment, intermediate layer 106 may be in the shape of a flat ring which t springs 104 are attached to. In another embodiment, layer 106 may be formed into a hollow sphere in which springs 104 are attached to the inside surface of layer 106. Two examples of materials, which may be used for layer 106, include metal or plastic.

Ball 100 may further include an outer core 108. Outer core 108 extends from layer 106 to cover 110. The outer core may be constructed from any material of choice. Functionally, a preferred material of construction of core 108 is a material, which will not absorb all forces applied to an outer surface of core 108. It is preferred that core 108 transfers a sufficient amount of force applied to its outer surface that users of ball 100 may realize the benefits of practicing the game of baseball with ball 100. One of such benefits is the variability in the rolling path of ball 100 as it travelers toward a fielder. Another such benefit may be a certain unpredictability in the flight path of ball 100 as it travels through the air. As the disclosure herein is practiced further benefits will become apparent to the user.

As for cover 110 of ball 100, the cover may be any color of choice. It is not limited to white and in many instances cover 110 may be a non-white cover. Additionally cover 110 may include the afore discussed images.

In another embodiment, when ball 100 is at rest or moving in a smooth arc, the ring and springs are essentially in the same plane. When ball 100 hits the ground, mass 102 may compress or extend one or more of springs 104 to cause the motion of ball 100 to vary from what would be expected. Other configurations of springs 104 and intermediate layer 106 are feasible and are within the scope of this disclosure.

The afore ball 10 may be used as a teaching aid for teaching players how to field a baseball. Preferably ball 10 is directed towards a fielder. Ball 10 may be directed by hitting ball 10, throwing ball 10, or any other manner of moving ball 10 in the direction of a fielder. The fielder is instructed to announce the image visible to the fielder as the fielder fields ball 10. Alternatively, the fielder may announce the image upon receiving ball 10 or sometime prior to releasing ball 10. Releasing ball 10 includes at least the fielder throwing ball 10 to another baseball player, the fielder placing ball 10 on the ground in one fashion or another, or any other activity in which a fielder would use ball 10 to make a baseball play. In an alternative embodiment, the fielder is instructed to announce the most visible image as soon as the fielder secures ball 10 in his/her baseball glove or hand. In one embodiment, the fielder will announce the image as soon as the fielder fields the baseball in his or her baseball glove.

Another method disclosed herein may include a method of selling ball 10. The method includes offering for sale ball 10. In offering for sale ball 10, it may include instructions for the instructor to have a fielder announce the image or the color of the image as stated above. The method may also include selling ball 10. The method may further include advertising ball 10 for sale.

Baseballs in accordance with the disclosure can be used to provide a fielding-practice ball that encourages the learning player to visually follow the ball into his/her glove to the completion of the catch by including at least four, in one embodiment up to six, images on the ball that are to be identified and vocalized to the coach and/or trainer by the player prior to the completion of the play, preferably before the ball is removed from the glove for completion of the play. In one embodiment of the ball, each image is positioned on the ball centered on each face of an imaginary cube that would encase the ball. Optionally, each image is symmetrically oriented with respect to the panels forming the cover. It is further preferred that each image is observable from a different direction (top, bottom, left, right, front, and back). In a further embodiment, the type of image used may also serve as a reminder of the purpose of the practice. In a further embodiment, asymmetries within the ball may be provided to induce unpredictability in the bounce and/or rolling path of the ball to further challenge visual tracking of the ball.

One way to make ball 10 is with the use of one or more ink-stamping tools. The tool may include the desired image. The tool is used to apply the image to ball 10. Furthermore, the image may be given any desired color through the use of different colored inkpads. In another alternate embodiment, an unmarked ball and a plurality of tools may be sold together. A user of the ball may apply his or her stamps, of a chosen color to the ball. The stamps are note limited to being for the images shown in the figures and user may use his choice of color. In an alternate embodiment, only one ink-stamping tool is used. The ink-stamping tool includes an outline of an image. The image may be applied to ball 10 and the outline of the image may be colored in by other means, such as by hand or automation. In one certain embodiment, the ink-stamping tool may include the outline of the eye including the iris. After application of the outline of the eyeball, the iris of the eyeball may be colored-in. The images may be the same color or any combination of different colors.

Advantageously, the disclosed ball may be used to provide a practice baseball that includes visual, easily identifiable images on the outer surface of the ball. The fielder will be challenged upon fielding the ball to verbally identify the images as the ball is caught in the fielder's glove. This encourages the fielder to watch the ball throughout the entire catch. Instant verbal identification by the fielder allows evaluation by the coach of the fielder. The coach may use the verbal identification to encourage improvement of the player's performance, provide additional feedback to the fielder, or for other purposes, as the coach deems necessary.

Advantageously, the baseball may include images that inherently suggest to the fielder that his/her eyes should be focused on the ball throughout the catch by the choice of images printed on the cover in the form of an eye or eyes. Preferably the eyes are different color thereby, reinforcing the message to the fielder of keeping his/her "EYES ON THE BALL" as the player calls out the eye color once each ball is caught.

One embodiment disclosed herein includes a baseball with images for the fielder to identify during the catch, and also includes an internal displaceable mass to add a random component to a ground ball as it bounces along the ground to further challenge the fielder to visually follow the ball all the way into his/her glove.

It is contemplated that by using ball 10 a baseball player will improve his/her ability to field the baseball.

The afore embodiments may be practiced in any combination thereof.

The above description is intended to enable the person skilled in the art to practice the invention. It is not intended to detail all of the possible variations and modifications that will become apparent to the skilled worker upon reading the description. It is intended, however, that all such modifications and variations be included within the scope of the invention that is defined by the following claims. The claims are intended to cover the indicated elements and steps in any arrangement or sequence that is effective to meet the objectives intended for the invention, unless the context specifically indicates the contrary.

What is claimed is:

1. A baseball comprising a core and a cover completely encapsulating the core, wherein the core is weighted in an asymmetric manner whereby the baseball rolls in an untrue manner, the cover includes at least two adjacent panels fixedly attached to one another and an exterior surface, wherein the exterior surface includes at least three images and no image on the exterior surface extends from one of the panels to another one of the panels.

2. The baseball of claim 1 wherein at least three of the images are disposed on one of the panels.

3. The baseball of claim 1 wherein no more than two of the images are disposed on any one of the panels.

4. The baseball of claim 1 wherein the images are all the same, except for the color of the image.

5. The baseball of claim 1 wherein each one of the images are different from each other.

6. The baseball of claim 1 having more than 2 panels and each panel includes an image.

7. The baseball of claim 1 wherein each image includes at least about 2 colors.

8. The baseball of claim 1 wherein each image comprises at least about 3 colors.

9. The baseball of claim 1 wherein each image comprises more than a monochromatic section of one of the panels.

10. The baseball of claim 1 wherein each image comprises other than a monochromatic section of one of the panels.

11. The baseball of claim 1 comprises a hardball.

12. The baseball of claim 1 wherein the exterior surface includes only four images.

13. The baseball of claim 1 wherein the exterior surface includes only six images.

14. The baseball of claim 1 wherein the baseball has a profile at least substantially similar to a conventional baseball.

15. An article comprising:

(a) a baseball having (i) a core weighted in an asymmetric manner thereby causing the ball to roll in an untrue manner, and (ii) a cover including at least two adjacent panels fixedly attached to one another, the cover completely encapsulating the core, the cover having an exterior surface, wherein the exterior surface includes four to six images, wherein no image on the exterior surface extends from one of the panels to another one of the panels.

16. A baseball comprising a hardball having a core and a cover completely encapsulating the core, wherein the core is weighted in an asymmetric manner thereby causing the baseball to roll in an untrue manner, the cover includes at least two adjacent panels fixedly attached to one another, the cover having an exterior surface, wherein the exterior surface includes at least four images, wherein no image on the exterior surface extends from one of the panels to another one of the panels.

* * * * *